United States Patent [19]

Deisinger et al.

[11] 3,969,910

[45] July 20, 1976

[54] SELECTION APPARATUS FOR PATTERN CONTROL ELEMENTS

[75] Inventors: Franz Deisinger, Ingolstadt; Gert Hüsges, Zuchering, Seehof; Erich Bock, Feldkirchen; Heinrich Niestroj; Detlef Henzgen, both of Ingolstadt, all of Germany

[73] Assignee: Schubert & Salzer Maschinenfabrik Aktiengesellschaft, Ingolstadt, Germany

[22] Filed: May 30, 1974

[21] Appl. No.: 474,579

[52] U.S. Cl. ..... 66/50 R; 66/1 R; 29/211 M; 19/145.5

[51] Int. Cl.[2] ..... D04B 15/74; D04B 15/76

[58] Field of Search ..... 66/50 A, 50 R, 75, 154 R, 66/154 A, 156, 25, 1 R; 29/211 R, 211 M; 19/145.5

[56] References Cited

UNITED STATES PATENTS

| | | | |
|---|---|---|---|
| 3,079,775 | 3/1963 | Schaeder et al. | 66/50 A |
| 3,290,898 | 12/1966 | Schaeder et al. | 66/50 A |
| 3,422,639 | 1/1969 | Saunders | 66/25 |
| 3,747,191 | 7/1973 | Kuhn et al. | 29/211 R |
| 3,820,359 | 6/1974 | Hanson et al. | 66/50 A |
| 3,823,579 | 7/1974 | Schindele et al. | 66/50 R |

FOREIGN PATENTS OR APPLICATIONS

| | | | |
|---|---|---|---|
| 1,401,262 | 4/1964 | France | 66/50 A |
| 1,244,060 | 8/1971 | United Kingdom | 66/1 R |

*Primary Examiner*—Mervin Stein
*Assistant Examiner*—Andrew M. Falik
*Attorney, Agent, or Firm*—Robert W. Beach; R. M. Van Winkle

[57] ABSTRACT

Free flight magnetizable selector elements are transferable from a selector element store disc to a selector element support disc for selecting particular ones of a series of textile processing implements in response to a program. The discs are disposed with an arcuate portion of one disc closely adjacent to an arcuate portion of the other disc, and the selector elements are transferred from store disc sockets to support disc sockets and vice versa by a transfer magnet. The discs include magnets with opposite polarity to maintain transferred selector elements in the sockets of the selected disc until the transfer magnet effects another transfer. The sockets of the store means and support means have the same pitch as the textile implements; however, the sockets of the entire support means may be distributed among a set of identical superjacent discs each having a socket pitch an integer multiple of the textile processing implement pitch. The store means has a corresponding set of superjacent discs. The cooperating store means and support means disc pairs may be disposed in a common plane or in intersecting planes.

7 Claims, 8 Drawing Figures

SELECTION APPARATUS FOR PATTERN CONTROL ELEMENTS

Figure 1:
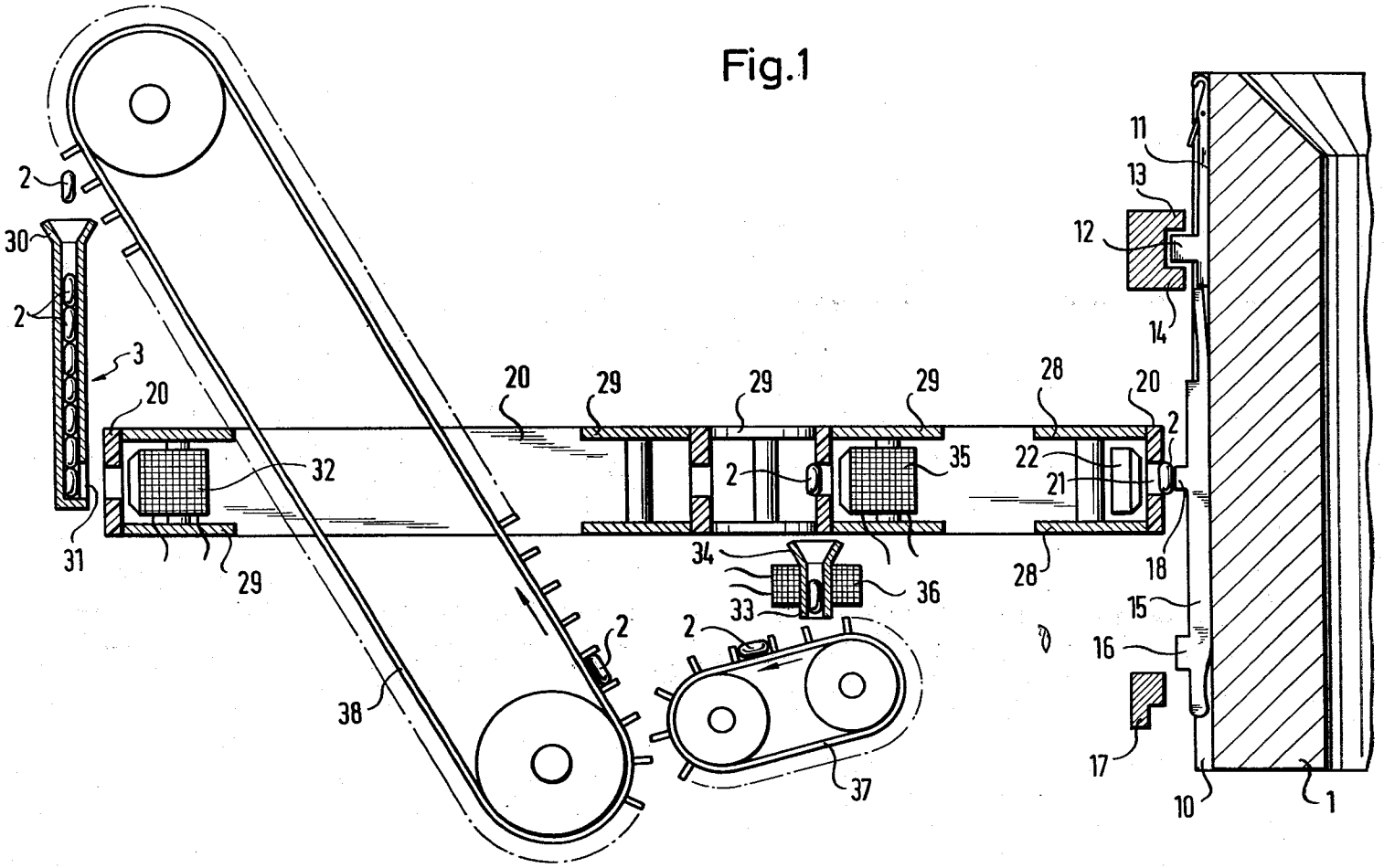

The present invention relates to apparatus for selecting control elements of a textile machine which are influenced by selector elements which are in turn movably supported in support means and are influenced by a program.

The needles of circular knitting machines must be individually selected to permit the production of patterned knitted goods. The most diverse selecting devices have been disclosed to this end. Electromagnetic devices have been increasingly developed, more particularly in recent years (Wirkerei- und Strickerei Technik 1972, pages 195 et seq). Selection by means of a pattern wheel had also been performed (French Pat. Specification Nos. 1,329,148 and 1,453,411, also British Pat. Specification No. 1,088,413). Resilient intermediate elements which entered into a re-entrant cam when a control or selector magnet was operated and entered into another re-entrant cam on being released by the control magnet were always employed in such cases. However, it has been found that installation and precise adjustment of these sensitive resilient elements is exceptionally difficult and must be performed with extreme care. Similarly, springs are used as the control element in needle carriers but limit the operating speed (French Patent Specification No. 1,391,337). A substantial disadvantage of these devices is diminishing functional reliability due to the fact that the constant tolerances of a spring vary widely, more particularly due to fatigue.

It is the task of the present invention to create a selecting device which is applicable in many ways, which works without elastic elements, and which makes possible a safe and quick manner of operation.

According to the invention the problem is solved by the provision of a selector element store which precedes a selector element support and means to transfer the selector elements, in accordance with a program, to the selector element support, which store collects the selector elements which are not required for selection. Advantageously, both the selector element support as well as the store have the same number of divisions for accommodating selector elements and rotate in pitch synchronism in association with a selector element transfer position. To increase the operating speed the selector element transfer position is preceded by a selector element return position for returning the selector elements into the store. According to one preferred embodiment of the subject of the invention the selector element support and the store are discs; an arc of one disc is located closely adjacent to an arc of the other disc, which adjacent arcs constitute the selector element transfer position. The store and the selector element support can be disposed in the same plane or in intersecting planes. According to a further feature of the invention the store and the selector element support are provided with magnetic retaining rings of opposite polarity. The store and the selector element support may be provided with a plurality of superjacent discs for very narrow pitches, the pitch being a multiple of the pitch of the needle carrier in accordance with the number of superjacent discs and the superjacent discs of the selector element support and of the store being rotated with respect to each other by one pitch of the needle cylinder.

The selector element is preferably constructed as a ball because this shape offers the least operating resistance because of the low friction.

The components at the control position and accordingly also the store and the selector element support means can be differently constructed. Advantageously, the periphery of the store and the periphery of the selector element support means each being a magnet, the magnets of the store and of the selector element support being of opposite polarity and a additional magnet being disposed on the selector element transfer position. The magnets of opposite polarity can be controllable electromagnets and the additional magnet on the selector element transfer position can have a set polarity. Advantageously, however, both magnets in polarity opposition have a set polarity while the additional magnet on the selector element transfer position is constructed as a controllable electromagnet. To improve adjustment of the selector elements and to intensify and accelerate such adjustment a further feature of the invention provides that a second pole piece of the same polarity is associated with the additional magnet at the selector element transfer position.

The selector element transfer position can however also be differently constructed. According to a further feature of the invention the store as well as the selector element support have co-operating ports which are disposed at the pitch of the selector elements and are adapted to co-operate therewith and with separate stationary compressed air nozzles. Advantageously, the compressed air nozzle has a substantially cylindrical interior which accommodates an axially slidable closure part with at least one air passage provided on the circumference, the end nearest to the exit side of the nozzle being constructed as a sealing member and the internal space and/or the closure part being provided with concentric notches at the end nearest to the inlet side, the interior chamber being surrounded by an electromagnetic coil which draws the closure part to the inlet side on the interior chamber half which is nearest to the inlet side.

It is known to apply pneumatic control to sinkers in pattern wheels or in the cylinder (German Auslegescrift 1,585,188 and U.S. Pat. No. 3,290,898). The compressed air nozzles are however movable between an operative position and an inoperative position thus preventing the desired operating speed being reached.

By contrast to known devices, the present invention offers the advantage that the dimensions of the selector elements can be very small and such elements can be directly moved without physical contact. Any reduction of functional reliability with increasing wear of control surfaces on which the selector elements slide at the selector element transfer position is practically eliminated in the principle according to the invention. Despite the selector principle of the selector element which operates without physical contact, selection of the knitting elements is purely mechanical thus achieving a high degree of functional reliability. This enables the operating speed to be increased so that the production rate of circular knitting machines is not restricted by the patterning device.

The invention can also be successfully applied to other textile machines in which selections have to be made, for example in fiber mixing apparatus such as disclosed in U.S. Pat. Nos. 3,577,599, 3,797,072 and 3,806,990 by means of which different batches of material are blended in the desired manner for roving operations. For example, in the mixing device of U.S. Pat. No. 3,806,990, a selector apparatus of the type disclosed herein could be utilized to actuate the switches of FIG. 2 in place of the switching strips or, in the device of U.S. Pat. No. 3,577,599, could select which cams N1, N2, N3 are operative in place of the less flexible cam shaft arrangement.

Figure 2:
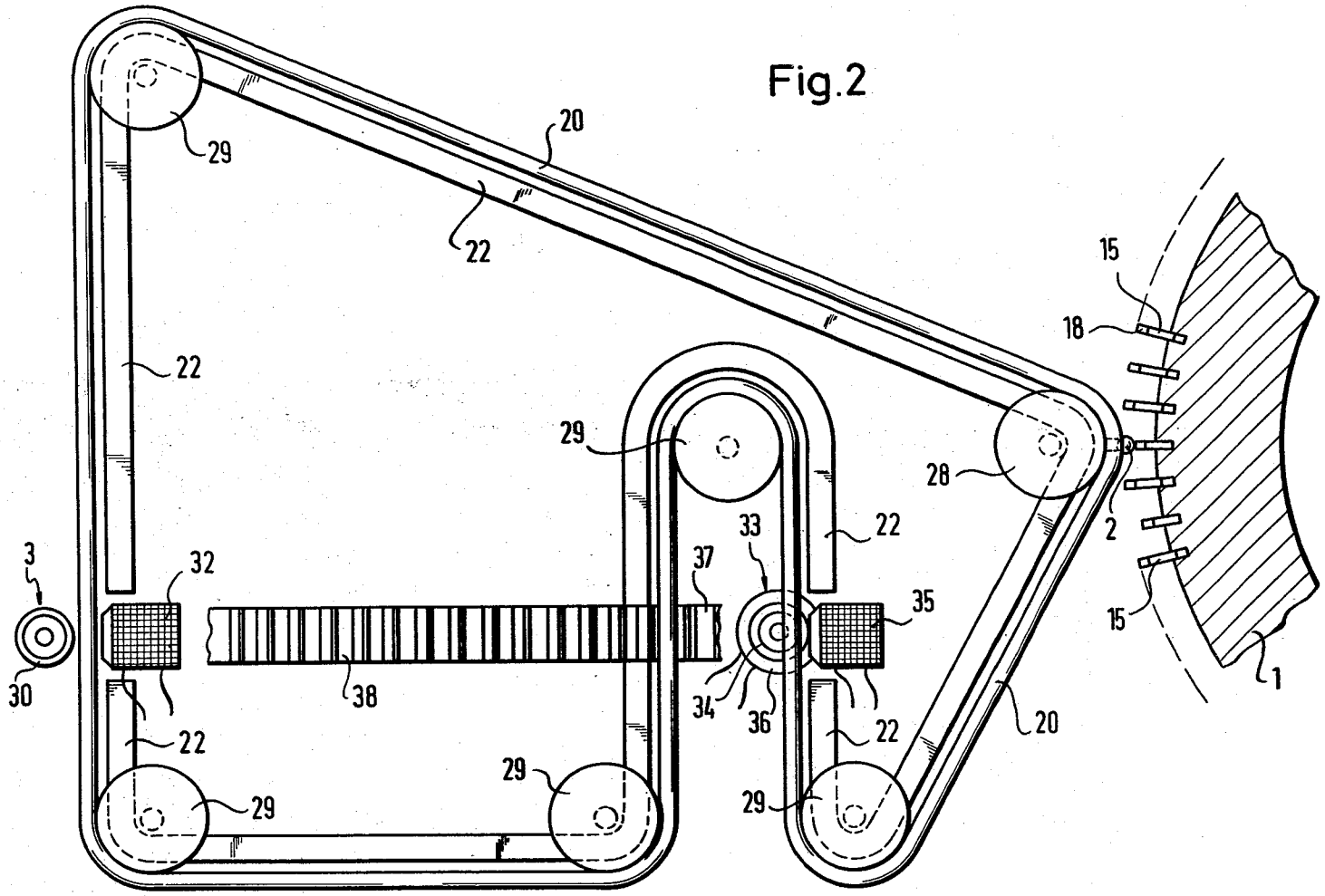
Figure 3:
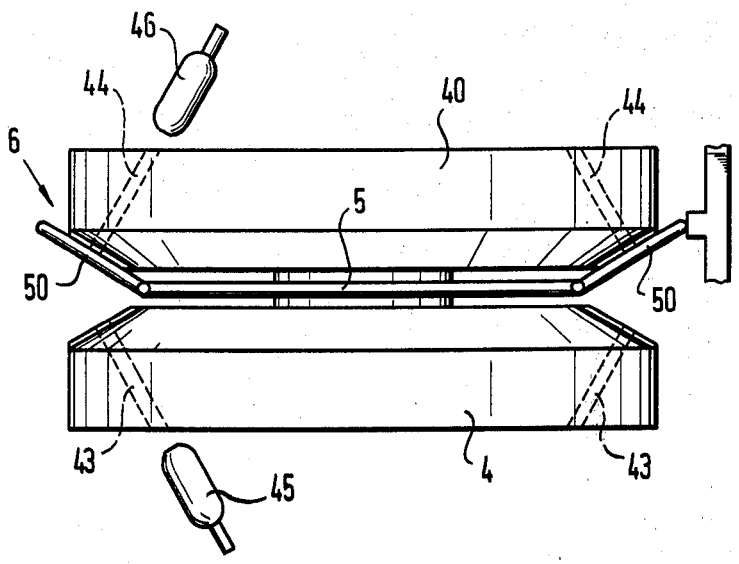
Figure 4:
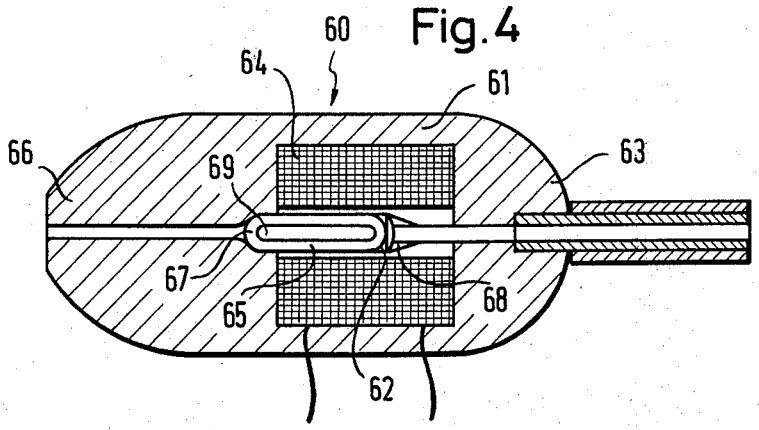
Figure 5:
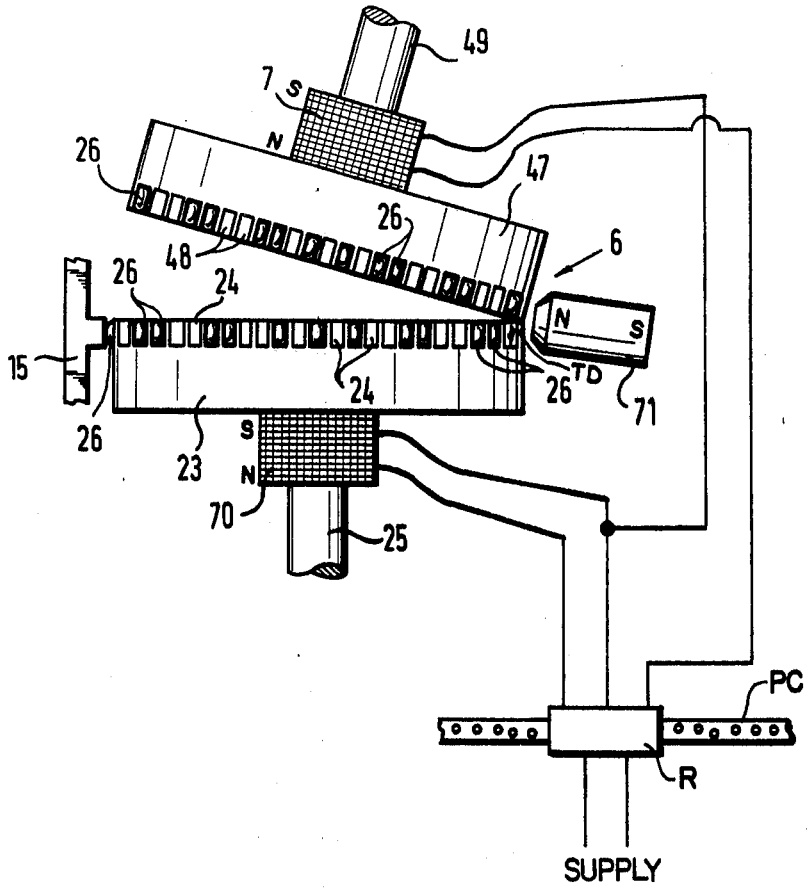
Figure 6:
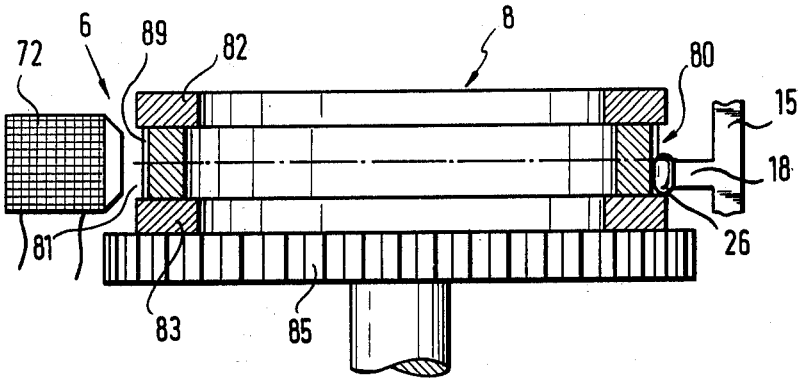
Figure 7:
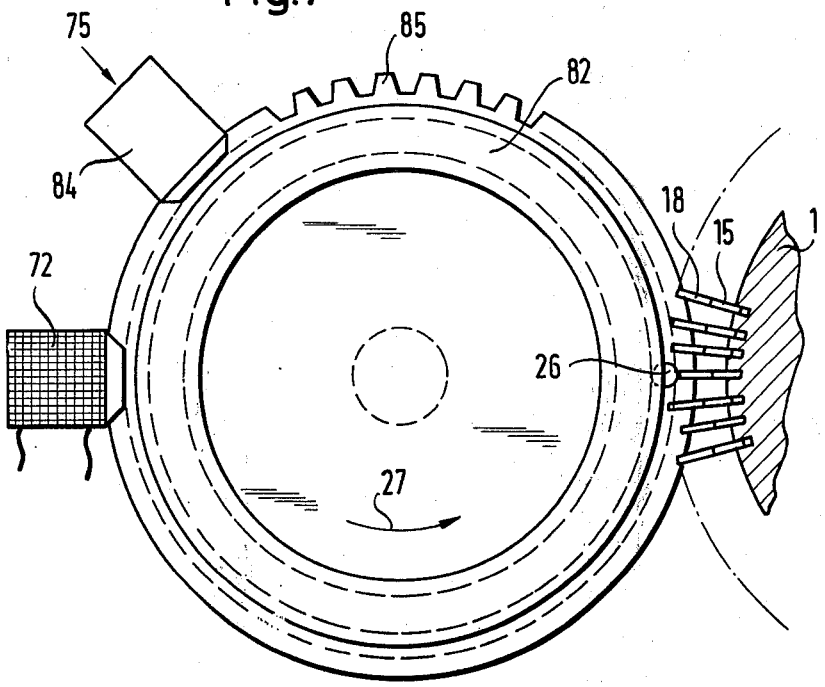
Figure 8:
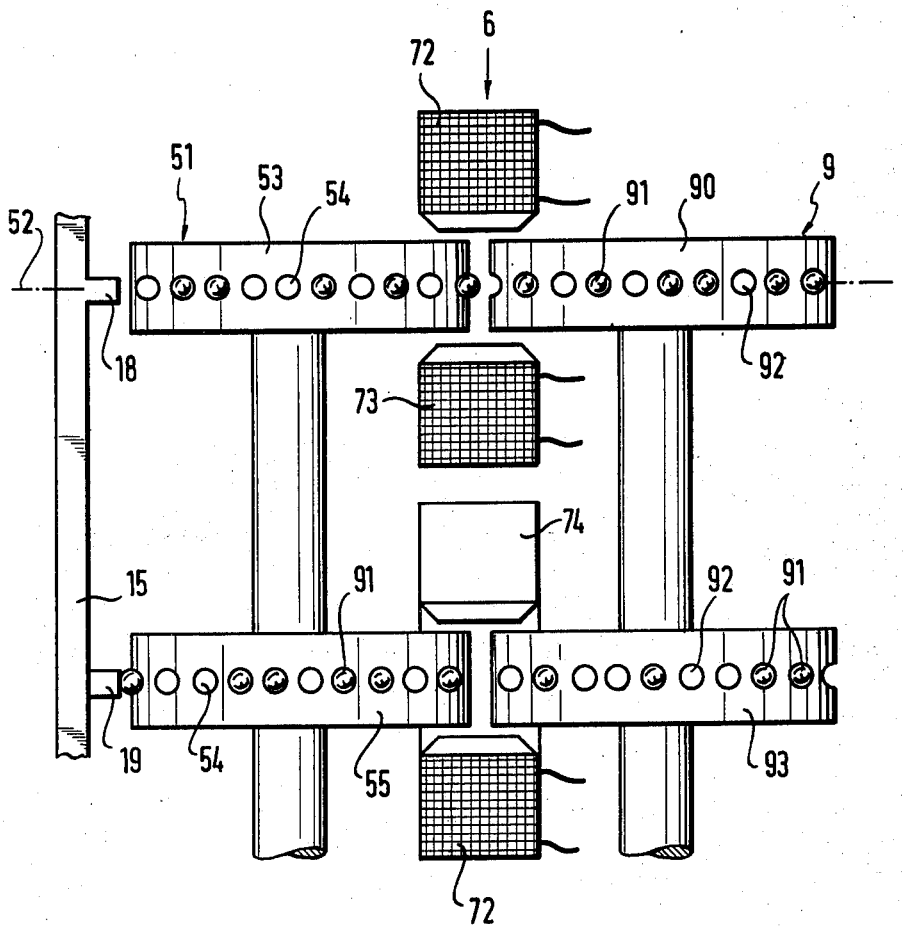

Further details and advantages of the invention are explained in the description hereinbelow by reference to the accompanying drawings, in which:

FIGS. 1 and 2 are a diagrammatic section and plan, respectively, of a first embodiment of the subject of the invention with a stationary store and a band-shaped selector element support, FIG. 3 is a side elevation of another embodiment of the device according to the invention with pneumatically operated selector elements, FIG. 4 is an axial section through a controllable compressed air nozzle for the device illustrated in FIG. 3, FIG. 5 is a side elevation of two discs in tangential configuration disposed with their radial planes relatively inclined and functioning as a store and a selector element support, FIG. 6 is a side elevation, with parts in section, of combined selector element support and store, FIG. 7 is a plan of the embodiment illustrated in FIG. 6, and FIG. 8 is a side elevation of a further embodiment of the store and selector element support.

The invention will be explained hereinbelow by reference to a circular knitting machine, but it can also be successfully applied to other textile machines. A first embodiment of the device according to the invention is explained by reference to FIGS. 1 and 2. Textile processing implements are provided in conventional manner in a needle carrier, for example, a dial or a needle cylinder. In the illustrated application the textile processing implements are constructed as latch needles 11, and needle control elements 15, slidable in slots 10 of a needle cylinder 1. Such slots define the needle pitch. The knitting needles 11 have an operating butt 12 on which cams 13 and 14 act in order to impart the operating motions to the knitting needles 11. The selection of knitting needles for knitting or non-knitting or tucking or non-knitting is performed by means of needle control elements 15 which are constructed as tilting sinkers. The needle control elements 15 have a lifter butt 16 by means of which they can be raised through a lifter cam 17 thus raising the knitting needles 11 to enable these to move into the zone of the cams 13 and 14. The needle control elements 15 are also provided with a selector foot 18 by means of which their lifter base 16 can be thrust out of the zone of the cam 17 into which it was previously moved be means of a pivoting cam which is not shown.

A selector element 2 which may be of diverse configuration can be adapted to act on the selector foot 18. In the illustrated embodiment the selector element 2 is substantially cylindrical with hemispherical ends.

The selector element 2 is retained by selector element support means 20 in the form of a band or chain which rotates in synchronism with the needle carrier 1 and has openings or sockets 21 defining a pitch corresponding to the pitch of needle carrier 1. A magnet 22, shown best in FIG. 2, is provided on the side of the selector element support 20 opposite the selector element, the magnet extending along the path of the selector element support means 20 to retain the selector elements in their sockets 21. The magnet 22 can comprise a plurality of magneets which can be constructed either as permanent magnets or as electromagnets. The selector element support means 20 and the needle carrier 1 are driven in pitch synchronism so that the selector elements 2 can operate the oppositely disposed selector feet 18 with reliability.

The selector element support means 20 is provided with selector elements 2 from a stationary store 3 in accordance with the pattern. The store 3 is constructed substantially as a tube which is closed at its bottom end and has a flared expanded collector 30 at its top end. The selector element support means 20 passes by the store 3 directly adjacent to its bottom end, the side of the store nearest to the selector element support means having an opening 31. The selector elements 2 can be transferred through the said opening 31 from the store 3 to the selector element support 20 by the action of an electromagnet 32 located between adjacent ends of the substantially continuous magnet 22. Electromagnet 32 can be controlled in accordance with a program, the selector elements being retained by the magnet 22 as the selector element support 20 continues to move.

A tube 33 with a collecting funnel 34 at the top is provided to remove from the selector element support means 20 any selector elements 2 which are not required. The selector element support means 20 passes over the collecting funnel 34. The substantially continuous magnet 22 is interrupted to provide a selector element return station at which a controllable electromagnet 35 transfers selector elements 2 to the collecting funnel 34. A further controllable electromagnet 36 is provided below the collecting funnel 34. A conveyor element 37 which co-operates with a further conveyor element 38 is disposed under the tube 33. The selector elements 2 which are delivered into the tube 33 are conveyed by the two conveyor elements 37 and 38 into the store 3.

The method of operation of the device whose construction was described hereinabove will now be described. The selector element support means 20 rotates in synchronism with the needle carrier 1. As each socket 21 passes, a program, not shown, determines whether the store 3, it is provided with a selector element 2. To this end and in accordance with the pattern, the electromagnet 32 is energized to pull the selector elements 2 from the store 3 into sockets 21 on the selector element support 20. A controllable electromagnet (not shown) which is synchronized with the electromagnet 32 can also be provided below the store 3 to accelerate the selector elements. As the selector element support 20 continues to travel the selector elements move into the zone of the magnet 22 by means of which the selector elements are held against the selector element support means 20.

The selector elements 2 then move into the zone of the needle carrier 1. The selector element support 20 is backed by reversing pulley 28 to press the selector elements 2 against the selector feet 18 of the needle control elements 15. The lifting base 16 is thus thrust out of the region of the lifting cam 17. If no selector element 2 is provided in an opening 21 of the selector element support 20, the lifting foot 16 will remain in the region of the lifting cam 17. The associated knitting needle 11 is thus raised into the tucking level or knitting level, depending on the construction of the cams 13, 14.

Further reversing pulleys 29, any desired number of which can provide the drive, are provided to guide the selector element support means 20.

After passing the operating point of the needle carrier 1, the selector element support 20 moves past the collector 33. If the needle control element 15 is not to be operated, the energized electromagnet 35 must release the selector element 2, i.e. the electromagnet must be briefly de-energized. To prevent the said released selector element 2 from being attracted by the belt 20 on renewed energization of the electromagnet 35 to retain the next selector element 2, de-energization of the electromagnet 35 is accompanied by energization of the electromagnet 36 so that this pulls the selector element 2 in the collecting funnel tube 33 away from the selector element support means 20.

Where appropriate it may be sufficient to de-energize the magnet 22 and thus to release all selector elements 2 so that the electromagnets 35 and 36 can be omitted if the collecting funnel is appropriately dimensioned.

The control signals for transferring selector elements 2 to the selector element support 20 are programmed in appropriately matched manner on the program medium which is not shown. To increase the operating speed it is also possible to provide more than one store 3 for loading the selector element support means 20. The selector elements 2 can also by conveyed from the collecting funnel 33 to the store 3 in a different manner.

Since stationary stores always give rise to the problem of transporting the selector elements 2 from the collecting funnel 33 to the store 3, the embodiments of FIGS. 3 through 8 show selector element stores which rotate in synchronism with the selector element support. In FIG. 3 the store 4 and the selector element support 40 are constructed in endless configuration. The selector element contact locations store 4 and selector element support 5 have the same pitch which corresponds to the pitch of the needle carrier in the illustrated embodiment. The number of contact locations also correspond in the store 4 and the selector element support 40. A common stationary selector element transfer position 6 is associated with the store 4 and the selector element support 40. The said selector element transfer position 6 may be disposed at any desired position along the store and the selector element support if the store and support are constructed as bands or chains and extend parallel with each other.

The subject of the invention can be particularly simply embodied if both the store 4 and the selector element support 40 are constructed as discs. According to FIG. 3, the selector element support 40 is then associated with a selector element carrier 5. The selector element support 40, the store 4 and the selector element carrier 5 disposed between the discs 4 and 40 are arranged with their radial planes parallel to each other. A pivotable selector element 50, which can be transferred at the selector element transfer position 6 by pivoting is provided for each contact location of the selector element support 40 or store 4. The selector element 50 is retained in the limiting positions by magnetic force to which end the store 4 and the selector element support means 40 are constructed as permanent magnets.

The selector element transfer at transfer position 6 can be effected by electromagnetic, hydraulic, pneumatic or other suitable means. According to FIG. 3 the store 4 as well as the selector element support 40 are provided with ports 43 or 44, each of the ports being adapted to cooperate with a compressed air nozzle 45 or 46.

The compressed air nozzle 45 or 46 must be constructed so that it is able to deliver air surges in rapid sequence. FIG. 4 shows a suitable compressed air nozzle 60. It has a body 61 with a substantially cylindrical interior chamber 62, the chamber portion nearest to the nozzle end 63 being surrounded by the coil 64 of an electromagnet. An axially slidable closure member 65 is disposed in the interior chamber 62, the end of the said closure member nearest to the outlet end 66 of the compressed air nozzle 60 being constructed as sealing member 67. On its longitudinal sides the closing member 65 is provided with air passages 69 in the form of flats, notches or grooves. On the inlet end 63, the interior chamber 62 is provided with concentric notches 68. Where appropriate they may also be provided on the end of the closure member 65 which is nearest to the inlet end 63.

The compressed air nozzle 45 or 46 is actuated at the selector element control position 6 in accordance with the pattern to transfer the selector element 50, which is held with only slight force on the store 4 or on the operating disc 40. The needle control elements are selected by selector elements 50 in the manner already described hereinabove.

The compressed air nozzle 60, which can be used as compressed air nozzle 45 and 46, is controlled by means of the coil 64. If the coil 64 is energized, the closing member 65 is pulled against the inlet end 63. Since notches are provided at this end and the closing member 65 is provided with air passages which extend longitudinally along the closure member, it is possible for air to flow past the closure member 65 to the outlet side 66 to adjust the selector element 50. When the coil 64 is de-energized, the compressed air propels the closure member 65 to the outlet side 66 so that the compressed air nozzle 60 is sealed by the end of the closure member sealing member 67.

The store and the selector element support discs are arranged with an arc of each disc disposed closely adjacent or in rolling contact with a corresponding arc of the other disc. A first embodiment thereof is shown in FIG. 5 where adjacent faces of a store 47 and a selector element support 23 intersect at a circumferential location on each disc. The radial plane of selector element support 23 in this case is disposed perpendicularly with respect to the longitudinal axis of the needle control elements 15 but the store 47 is in contact with the selector element support means 23 merely on the tangent which is common between them. The angle between the radial planes of the discs may amount to up to 180°. This special case will be described below by reference to FIG. 8.

In the embodiment illustrated in FIG. 5 the adjacent faces of the store 47 and the selector element support 23 enclose an acute angle and have inwardly opening recesses or sockets 24 and 48 for the cylindrical selector elements 26. If the selector elements are spherical the depth of the recesses 24 and 48 need merely be equal to half the diameter of the ball. The store 47 and the selector element support 23 can rotate in synchronism with each other like a pair of bevel gears although, where appropriate, may be driven independently without physical contact.

The store 47 and the selector element support 23 are constructed as magnets of opposite polarity which are associated with a further magnet 71 at the selector element transfer position 6. In the illustrated embodiment the magnets of opposite polarity are constructed as controllable electromagnets; and for this reason the shaft 49 of the store 47 supports a coil 7 with a specific winding direction and the shaft 25 of the selector element support means supports a coil 70 with an opposite winding direction. The coils 7 and 70 are simultaneously operated, by reader R in response to a program carrier PC (FIG. 5) current flowing through the said coils in one or the other direction depending on the transfer direction of the selector element 26. The second magnet 71 can be constructed as an electromagnet whose polarity cannot be reversed and through which current flows continuously or it can be constructed as a permanent magnet. The function of this additional magnet is to reinforce one magnetic field in order to effect transfer of the selector element 26 to the store 47 or to the selector element support 23. Magnet 71 is constructed so that the portion of its magnetic field having an intensity sufficient to overcome the attracting force of disc 47 or 23 on a selector element 26 is confined to the area of a single socket pitch.

By way of example, in FIG. 5 is indicated one of the four possible conditions at the transfer station. The arrow TD indicates the transfer direction of a selector element 26 and the corresponding polarities of magnets 7, 70 and 71. A selector element 26 does not have a polarity except as induced on it by its socket so that a selector element will remain in its socket even though the polarity of the socket disc is reversed repeatedly. As stated above, discs 23 and 47 have reversible polarity, but are always of polarity opposite to each other and the transfer magnet 71 has fixed polarity. The effect of the transfer magnet is to induce its polarity on a selector element so that the element will be attracted by the disc 23 and 47 having opposite polarity and repelled by the disc having the same polarity as the transfer magnet.

In the example illustrated by FIG. 5, selector element 26 is in a store socket 48, disc 47 and transfer magnet 71 have the same polarity and disc 23 has the opposite polarity. Result: The selector element is repelled by disc 47 and is attracted by disc 23 so that it is transferred in the direction of arrow TD to the corresponding, aligned socket 24 in support disc 23 for operating on the foot of a needle selector element 15. If a selector element of the disc 23 is to be transferred to the disc 47, the polarity of the electromagnets 7 and 70 is reversed.

FIGS. 6 and 7 show and embodiment of the subject of the invention in which the store 80 and the selector element support 81 are situated parallel to each other. The store 80 forms one half and the selector element support means 81 the other half of a member 8, each of the two edges of which are provided with a magnetic retaining ring 82 or 83. The hollow member 8 is disposed on a gear wheel 85 which is driven by the needle carrier 1 in a manner not shown.

The magnetic retaining rings 82 and 83 of the store 80 and of the selector element support 81 have opposite polarity. Opposite poles therefore face each other; for example, the south pole of the magnetic retaining ring 82 points to the magnetic retaining ring 83 and the north pole thereof points to the magnetic retaining ring 82. A magnetic field in which the selector element 26 is retained, even against the centrifugal force which occurs as a result of rotation of the member 8, is therefore established between the retaining rings 82 and 83. The selector element transfer position 6 is provided with a controllable electromagnet 72 through which current flows in one or the other direction in accordance with the pattern, thus assisting the action of one or the other magnetic rings. Depending on the current flow direction in the electromagnet 72 the selector element is pulled in its groove or socket 89 in the body 8 as far as the magnet retaining ring 82 or 83 which functions as stop abutment. The previously described embodiment of the subject of the invention can be modified by energizing or de-energizing the electromagnet 72 in only one flow direction. The selector elements 26 are returned into the basic position, i.e. into the store 80, at a selector element return position 75 by means of a permanent magnet or by means of an electromagnet 84 whose polarity is not reversible.

The member 8 is driven via the gear wheel 85 by the needle carrier 1, for example, the needle cylinder or a dial, in the direction of the arrow 27. The selector elements which were previously not selected continue to bear upon the magnetic retaining ring 82 and cannot therefore influence the selector feet 18 of the latch needles 11 or the needle control elements 15. The needles will therefore knit. When the electromagnet 72 is energized it transfers the selector element 26 disposed in the operating region thereof from the magnetic retaining ring 82 to the magnetic retaining ring 83 by which it is retained until the selector element 26 has passed the needle carrier 1 and has acted on the selector foot 18. The selector element 26 then moves into the zone of action of the magnet 84 of the selector element return position 75 where all selector elements 26 which were previously influenced by the electromagnet 72 are again returned into the store 80.

Although the disc magnets 23 and 47 having opposite polarity, as shown in the embodiment illustrated in FIG. 5, are shown and described as controllable electromagnets and the transfer magnet 71 is shown as a permanent magnet, the corresponding magnets of the embodiment illustrated in FIGS. 6 and 7 are just the opposite. The ring magnets 82 and 83 having opposite polarity are permanent magnets while the transfer magnet 72 is a controllable electromagnet.

According to one preferred embodiment of the invention, as shown in FIG. 8, the store 9 and the selector element support 51 are disposed in the same plane 52. The store 9 and the selector element support 51 are constructed as discs 90 and 53, respectively. The sockets 92 and 54 receive the selector elements and define the pitch of the store and selector element support. In the illustrated embodiment, the selector elements are constructed as balls 91 and for this reason the sockets 92 and 94 substantially hemispherical. The selector element transfer position 6 is again provided with a controllable electromagnet 72 which is associated with an additional pole piece 74 that has the same polarity. The additional pole piece may be part of the transfer magnet, in this case for example the electromagnet 72; it may however also be constructed as an independent electromagnet 73 which is controlled in synchronism with the electromagnet 72 or it may be constructed as a permanent magnet of the same polarity if a permanent magnet is provided in place of the controllable electromagnet 72. The additional electromagnet 73 or pole piece 74 reinforces the action of the electromagnet 72. The discs 90 and 53 are again constructed in the form of a permanent magnet or as the armature of electromagnets of non-reversible polarity, the disc 90 forming one pole and the disc 53 the other pole. The additional pole piece 74 or the electromagnet 73 ensures straight flight of the ball 91 from one disc to the other. If only one electromagnet is provided, the ball 91 is deflected from a straight path and reaches the socket of the other disc with a specific deviation which would result in increased wear of the balls and sockets.

If the needle cylinder has a fine pitch, the store 9 and the selector element support 51 may comprise a plurality of disc pairs, which disc pairs are disposed in parallel planes and which are further disposed in spaced, superjacent relationship. The discs of each pair are identically constructed but rotated with respect to the adjacent disc pairs by one pitch of the needle carrier. The pitch of the disc pairs is an integer multiple of the pitch of the needle cylinder, which integer is equal to the number of disc pairs. According to FIG. 8 the selector element support 51 is provided with two discs 53 and 55 and the store 9 has two corresponding discs 90 and 93. The pitch of the discs 90, 93, 53 and 55 is therefore twice as great as the pitch of the needle carrier 1. Since the two discs 90 and 93 or 53 and 55 are complementary, the composite selector element support 51 and the composite store 9 each have the same pitch as the needle carrier 1. The electromagnets 72 of the two disc pairs 90, 53 and 93, 55 are alternately actuated in accordance with their relative rotation. Selection on the needle carrier 1 is also performed alternately by one ball 91 in the disc 53 or one ball 91 in the disc 55. The needle carrier 1 is correspondingly provided with needle control elements 15 of which only every second is equipped with a top selector foot 18 and the intermediately disposed needle control elements have only a bottom selector foot 19 or each needle control element 15 has a top selector foot 18 and a bottom selector foot 19 which can be engaged alternatively by a selector element 91 on disc 53 or disc 55.

The present invention offers numerous advantages. The basic setting of the store 3, 4, 47, 80, 9 is very simple in all cases and is achieved simply by inserting selector elements 2, 50, 26, 91 without reference to the desired pattern. The selector elements 2, 50, 26 or 91 are selected directly at the selector element transfer position 6, i.e. without interposition of any other elements such as springs and the like, so that increased reliability is achieved. Since the selector elements are very small and offer practically no frictional resistance the device according to the invention can also operate very rapidly. Exceptionally high indexing speeds are possible, more particularly in embodiments of the subject of the invention in which the store and the selector element support each has an arc which is closely adjacent to an arc of the other at the transfer location because transfer of the selector elements from the store to the selector element support or vice versa takes place practically without traversing through any distance. The store and selector element support may roll upon each other in physical contact in pitch synchronism with each other while maintaining a slight distance.

The transfer of the selector elements 2, 50, 26 or 91 is controlled by conventional program media through pneumomechanical, hydromechanical or electromechanical means which permit high operating speeds to be performed in view of the small mass of the selector elements.

What we claim is:

1. In a textile machine having a series of substantially equally spaced textile processing implements, program means for indicating sequence of selection of the processing implements, a plurality of selector elements, each movable between an inoperative and an operative position for selecting processing implements in accordance with the program means, selector element store means for receiving the selector elements in their inoperative positions, and selector element support means for supporting the selector elements in their operative positions and including socket means for receiving the selector elements, the socket means being spaced apart and defining a pitch corresponding to the pitch of the textile processing implements, apparatus for selectively moving the selector elements between their inoperative and operative positions comprising a first disc in the selector element store means including first magnet means for maintaining unselected selector elements on said first disc, a second disc in the selector element support means carrying the socket means and including second magnet means for maintaining selected selector elements on said second disc, said discs being disposed with an arc of said first disc adjacent to an arc of said second disc between which arcs selector elements are transferred, said first and second magnet means being of opposite polarity, and third magnet means for transferring selector elements along a path between said first disc arc and said second disc arc.

2. In the textile machine defined in claim 1, the store means disc and the support means disc being disposed in a common plane.

3. In the textile machine defined in claim 1, the selector element support means including a plurality of superjacent discs, each having circumferentially spaced sockets therein defining a pitch for the disc which is an integer multiple of the pitch of the textile processing implements corresponding to the number of superjacent discs, the sockets of each superjacent disc being circumferentially offset relative to the sockets of every other superjacent disc to the extent of at least one textile processing implement pitch distance, and the selector element store means including a corresponding plurality of superjacent discs, each of said store means discs having an arc adjacent to an arc of a support means disc between which arcs selector elements are transferred.

4. In the textile machine defined in claim 1, each selector element being substantially spherical.

5. In the textile machine defined in claim 1, the first and second magnet means being controllable electromagnets and the third magnet means being a permanent magnet.

6. In the textile machine defined in claim 1, the first and second magnet means being permanent magnets and the third magnet means being a controllable electromagnet.

7. In the textile machine defined in claim 1, the apparatus further comprising fourth magnet means having the same polarity as the third magnet means, said third and fourth magnet means being disposed at opposite sides of the selector element path between the store means and the support means.

* * * * *